US005205079A

United States Patent [19]

Lashley et al.

[11] Patent Number: 5,205,079

[45] Date of Patent: Apr. 27, 1993

[54] POWERED TOOL

[76] Inventors: Anthony W. Lashley, Rte. #1, Box 914, Grover, N.C. 28073; Paul R. McKerahan, P.O. Box 313, Whittier, N.C. 28789

[21] Appl. No.: 754,410

[22] Filed: Sep. 3, 1991

[51] Int. Cl.[5] ..... B24B 23/00

[52] U.S. Cl. ..... 51/180; 51/170 TL; 51/175

[58] Field of Search ..... 51/180, 170 R, 170 TL, 51/175, 174

[56] References Cited

U.S. PATENT DOCUMENTS

| | | | |
|---|---|---|---|
| 1,476,433 | 12/1923 | Vandervoort | 51/170 TL |
| 1,737,135 | 11/1929 | Windfeldt | 51/170 TL |
| 2,210,733 | 8/1940 | Schmid et al. | 51/170 TL |
| 2,526,976 | 10/1950 | Smith | 51/170 TL |
| 3,007,230 | 11/1961 | Riedl | 51/170 TL |
| 4,204,292 | 5/1980 | Lester et al. | 51/180 |
| 4,663,796 | 5/1987 | Helling et al. | 51/180 |
| 4,685,252 | 8/1987 | Ponce | 51/180 |
| 4,782,632 | 11/1988 | Matechuk | 51/180 |
| 4,829,719 | 5/1989 | Braselton | 51/180 |
| 4,893,437 | 1/1990 | Doherty | 51/170 TL |
| 4,974,371 | 12/1990 | Conboy | 51/180 |

*Primary Examiner*—Roscoe V. Parker
*Attorney, Agent, or Firm*—Carter and Schnedler

[57] ABSTRACT

"A hand held and operated, portable, wand type wall sanding machine, powered by a motor. The motor powers a drive chain which produces a reciprocating action that is transmitted to a sanding (work) head located at the apex of said wand. The wand is adjustable, in length, so that high areas, as well as low areas, of the wall can be sanded, while the operator is standing on the floor. The sanding (work) head, or other interchangeable attachment, at the apex of the wand, is used to accomplish a specific task."

18 Claims, 1 Drawing Sheet

POWERED TOOL

BRIEF SUMMARY

The object of this invention is to improve the current method used to prefinish gypsum wall boards or dry wall, as used in the building construction trade, prior to the application of paint or wall paper.

At present, prefinishing dry wall construction is an arduous and time consuming task that is accomplished by the use of a wooden handle attached to a sanding pad, operated manually.

The invention herein described is an improvement in pole or wand type wall sanders, as described above, for the following reasons:

a) The power wall sander is powered by a motor, electric or air, thereby eliminating the time consuming, tiring use of a manually operated pole sander.

b) The power wall sander, with a rapid reciprocating movement of the sanding (work) head, gives a uniform finish to the wall area, leaving no sanding pattern upon the sanded wall.

c) The powered wall sander, is light in weight, portable, the work being done by a powered sanding (work) head, so operator fatigue is greatly reduced, therefore, production is increased.

d) The powered wall sander, with built in retractable extension rod, makes it ideal for working in confined areas such as corridors, while making high areas easy to reach without the use of ladders or scaffolding, thereby, increasing operator safety. A unique property of said retractable extension rod is flexibility, allowing it to assume a bow like shape when extended, while being stiff enough to allow pressure to be applied to the sanding (work) head when in contact with the wall area to be sanded.

e) The powered wall sander, being hand held and operated, portable, of a wand type that is adjustable in length to suit the job application, has other building construction work applications by the use of different work heads, other than the sanding (work) head. A blade type head will remove roof shingles or take up floor tile. A wire brush head will remove loose, blistered paint prior to repainting. A carbon stone head will remove mortar splatter from concrete block walls prior to painting. A polishing head will renovate scuffed, traffic dulled, resilient floor tile. It is evident that this invention, a powered wall sander, will be a valuable tool when used to sand wall board or used in other applications related to building construction.

DETAILED DESCRIPTION

Figure 1:
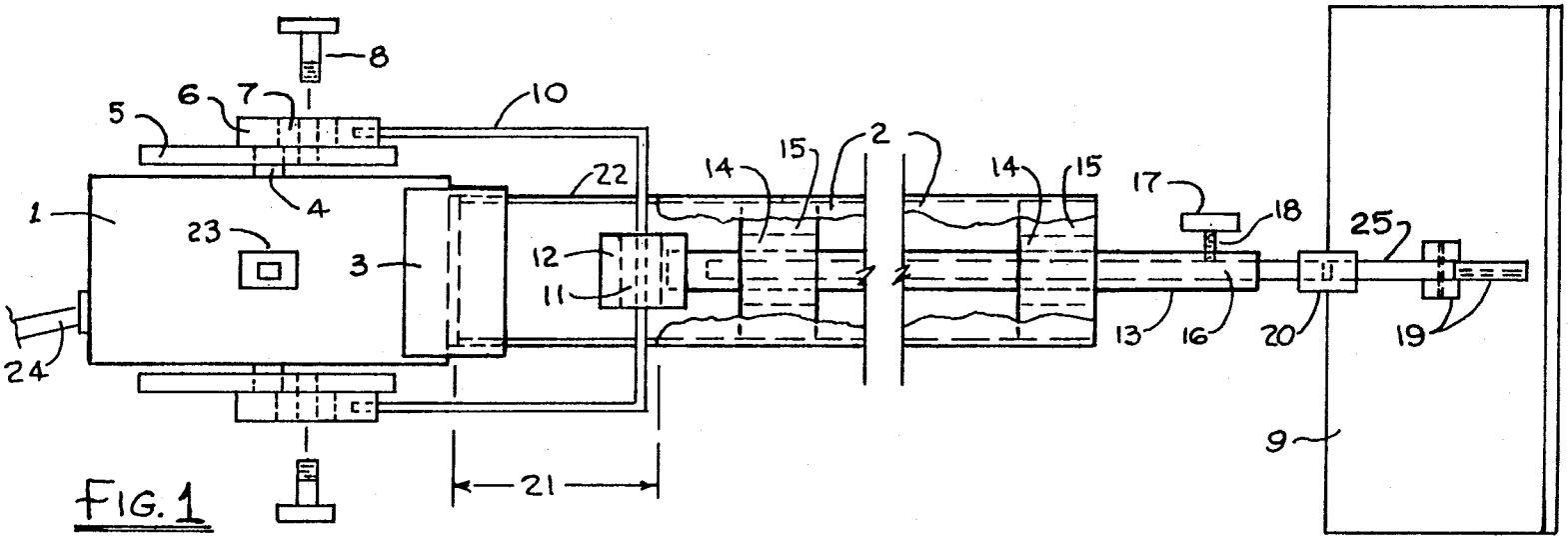
FIG. 1 is a top view of the Powered Wall Sander with cutaway of the body tube to show operating parts.
Figure 2:
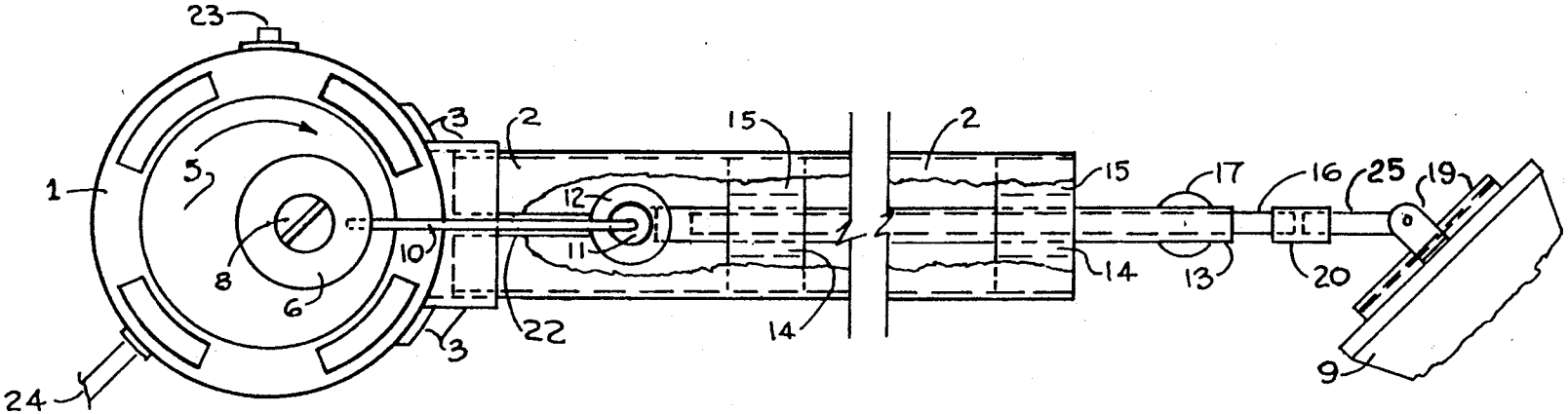
FIG. 2 is a side view of the Powered Wall Sander with cutaway of the body tube to show operating parts.

The detailed description has reference to the drawings shown as FIG. 1, top view and FIG. 2, side view. Now we will describe the parts of this invention.

Electric motor 1, furnishes power and motion to this device, is double shafted, flywheel 5, bearing housing 6, rotary motion bearing 7, shoulder bolt 8, are common to each motor shaft 4, said motor is energized by power cord 24, controlled by on-off switch 23.

Body tube 2, encloses some moving parts, acts as a handle to operate this devise, is force fitted to saddle 3, and has cut-out slot(s) 22. Within said body tube 2, the bearing housings 15, are fastened to it's interior walls, spaced so that the linear motion bearings 14, enclosed in bearing housing 15, support, align, guide, and allow free movement of reciprocating tube 13. The body tube 2, is of a length best fitted to the job application, therefore, the reciprocating tube 13, the extension rod 16, must be sized in length, relative to the length of body tube 2.

Saddle 3, having a radius on an arc surface, perpendicular, aligned, centered with a tube like configuration on it's opposite end, is fastened to the matching radius arc surface of the motor 1, housing. Body tube 2, is force fitted within the tube like configuration.

Motor shaft 4, integral with motor 1, is of a length and diameter to function with flywheel 5. See electric motor 1.

Flywheel 5, circular, flat faced, being of a diameter and thickness suitable to the job application, is threaded at a predetermined point upon its outer face, to receive shoulder bolt 8, then press fitted, at the center point of it's diameter upon motor shaft 4, the outer face of which must be flush with outer face of said flywheel 5.

Bearing housing 6, is flat, circular, and washer like, in configuration, having a shoulder depth and thickness that will allow rotary motion bearing 7, to be press-fitted therein. The legs of push-pull rod 10, are press-fitted, centered on the circumference face, perpendicular to shoulder bolt 8, longitudinal axis.

Shoulder bolt 8, is of a configuration such that rotary motion bearing 7, can ride freely on its shoulder, while said bolt is threaded into the face of flywheel 5, which is fastened, thereto.

Sanding (work) head 9, rectangular in shape, is of a size that will allow a standard piece of abrasive material to adhere or otherwise be secured to rigid face of same. See double swivel 19.

Push-pull rod 10, is U shaped, and of a diameter that will allow press-fitting to circumference face of bearing housing 6, will allow passage through rotary motion bearing 11, mounted so that the legs will be in parallel proximity to said flywheel 5, while the center of the configuration will be riding within, perpendicular to the raceway face of rotary motion bearing 11.

Bearing housing 12, which is round tube like, in configuration, a wall depth that will allow reciprocating tube 13, to be press-fitted, centered, on circumference face of said round and tube like configuration, with rotary motion bearing 11, press-fitted, centered, enclosed within.

Reciprocating tube 13, is press-fitted to, and is dependent for its reciprocating stroke upon the motion of bearing housing 12, carrying extension rod 16, slidable, within its walls, carrying, threaded through, perpendicular to its walls, set screw 18 and lock knob 17, while riding within the confines of linear motion bearing 14.

Bearing housing 15, round tube like, circular in configuration, has a wall thickness that will secure linear motion bearing 14, within it's walls. Said housing is held in place within walls of body tube 2, by a set screw that penetrates body tube wall and locks on bearing housing wall. See body tube 2.

Extension rod 16, being stiff but flexible when extended, snugly fits but is free to slide within the confines of reciprocating tube 13, is extensible and retractile, locked into place at any point along it's length, deemed proper for the job application, by set screw 18 which is integral with lock knob 17.

Lock knob 17, operated by a rotary motion, integral with, being the means by which set screw 18, is rotated through the threaded perpendicular hole in reciprocating tube 13, thereby, locking and unlocking, by applying or releasing a gripping force upon extension rod 16, which is located within reciprocating tube 13.

Double swivel 19, coupling devise is integral at its longish axis with the back side of sanding (work) head 9. Located above and perpendicular to the long axis, the short axis is integral with the double swivel rod 25. This arrangement gives flexibility of movement to the sanding (work) head 9, allowing the face side thereof, carrying the abrasive material, to contact the wall surface at the optimum angle.

Coupling 20, is round and tube like, and joins together the retractable extension rod 16 and the double swivel rod 25, by means of tightening a set screw(s), threaded perpendicular through the tube like wall of said coupling, thereby engaging, gripping and locking, on the circumference face of the rod like ends of above mentioned parts, inserted within the walls of said coupling. This same procedure is used to interchange other work heads, having rod like attachments, with sanding (work) head 9. These other work heads have varied work applications as a group, being used to accomplish a specific task when used in the singular, are not limited in number to those heretofore mentioned.

Length of reciprocating stroke 21, given to the push-pull rod 10, will equal the length of the reciprocating stroke given to the sanding (work) head 9. This length will be equal to twice the distance between the centers of motor shaft 4, and shoulder bolt 8, therefore, the length of cut-out slot 22, may vary in length, relative to the placement of the shoulder bolt 8, upon the flywheel 5, the width being slightly larger than the diameter of the push-pull rod 10. Length 21, indicates a maximum stroke that would occur if shoulder bolt 8, is placed upon flywheel 5, at the extreme distance allowable from the center of motor shaft 4.

Cut-out slots 22 are elongated and, parallel to longitudinal axis. Slots 22 are opposed by 180 degrees, placed at the end of body tube 2, that engages saddle 3. Said cut-out slots 22, being of a length and width so as to allow free movement of push-pull rod 10.

On-off switch 23, makes or breaks the electrical current fed to motor 1, by power cord 24, being mounted on top of motor 1, body housing. See electric motor 1.

Power cord 24, carries electrical energy from wall outlet, through switch 23, to motor 1, is of sufficient length to allow portability, so that this devise, the powered wall sander, can be operated while standing on the floor. See electric motor 1.

Double swivel rod 25, integral with double swivel 19, is of a size and length that will allow easy attachment to coupling 20. See double swivel 19.

It will thus be seen that the objects described and those made apparent by the foregoing description, are effectively achieved and since some changes may be made in the above construction without departing from the scope of the invention, it is intended that all matters contained in the specification shall be interpreted as illustrative and not in a limiting sense.

To operate powered wall sander, the motor 1, is activated by switching on the on-off switch 23, causing the motor shaft 4, the flywheel 5, which is press fitted thereto, to rotate. This rotation will cause the bearing housing 6, rotary motion bearing 7, press fitted therein, both fastened to flywheel 5, by shoulder bolt 8, to travel in a circular path, around the center of motor shaft 4. While in this circular travel, rotary motion bearing 7, will be riding on the shoulder of shoulder bolt 8, carrying along bearing housing 6, which is attached to the end of push-pull 10, in parallel proximity to said flywheel 5. This rotary, off centered motion of the bearing housing 6, will cause the push-pull rod 10, to move to and fro in a reciprocating manner, within the confines and dimensions of the cut-out slot 22.

The push-pull rod 10, passes through the rotary motion bearing 11, which is press fitted, within the bearing housing 12, which is press fitted to the reciprocating tube 13, all move in said reciprocating pattern.

Reciprocating tube 13, carries, within it's walls, a snug fitting but slidable, retractable extension rod 16, stiff but flexible when extended, adjustable in length, locked into place at any point along it's length by a set screw 18, threaded through the wall of said reciprocating tube 13, attached to and operated by a turning motion of lock knob 17, thereby gripping with pressure and locking said extension rod 16, within the inside diameter of said reciprocating tube 13. In a similar manner the coupling 20, joins together the extension rod 16, and the double swivel rod 25, each being secured by a set screw threaded perpendicularly through the wall of said coupling 20.

Double swivel rod 25 is integral with double swivel 19, which in turn is integral with said sanding (work) head 9, therefore, all move together in said reciprocating pattern.

The body tube 2, encloses some moving parts and acts as a handle to operate this devise, is force fitted to the saddle 3, which is fastened to the housing of motor 1. Within the said body tube 2, the bearing housings 15, are fastened, spaced so that the linear motion bearings 14, enclosed within the bearing housings 15, support, while allowing free movement of the reciprocating tube 13.

To use powered wall sander; energize power cord 24, turn to "on" position, using the on-off switch 23. Hold body tube 2, firmly, with both hands, while finding a comfortable balance, or "feel" for this devise. Approach wall area to be sanded and apply sanding (work) head 9, using moderate pressure, at an oblique angle to the wall.

We claim:

1. A powered tool comprising:

means for supplying power to operate said tool;

a first hollow tube;

a drive train connected to said means for supplying power;

a second hollow tube connected to said drive train; at least portions of said second hollow tube received in said first hollow tube; a retractable extension rod; portions of said retractable extension rod received within said second hollow tube; means for locking and unlocking said retractable extension rod attached to said second hollow tube; swivel means connected to said retractable extension rod; a work head; said work head connected to said swivel means;

a housing enclosing said means for supplying power; a saddle attached to said housing; said first tube being attached to said housing through an opening in said saddle; wherein said first tube includes a pair of elongated slots; a push-pull rod attached to said means for supplying power and to said second tube; said push-pull rod passing through at least one of said slots.

2. The powered tool of claim 1, wherein said means for supplying power is an electrical motor.

3. The powered tool of claim 1, further including a bearing housing received inside said first tube; at least a pair of linear motion bearings enclosed in said bearing housing; said linear motion bearings centering, supporting, aligning, guiding and permitting free movement of said second tube.

4. The powered tool of claim 1, including a motor shaft forming a part of said motor;

a pair of flywheels connected to opposite ends of said motor shaft;

first and second rotary bearing housings connected to said flywheels; rotary motion bearings received within said first and second rotary bearing housings; each of said first and second rotary bearing housings located near the outer periphery of said flywheels.

5. The powered tool of claim 4, wherein said push-pull rod is substantially U-shaped; the respective ends of said push-pull rod are connected to said first and second rotary bearing housings; a third rotary motion bearing housing received in said first tube; a portion of said U-shaped push-pull rod passes through said third rotary bearing housing; rotary bearing received in said third rotary bearing housing; said second tube is connected to said third rotary bearing housing.

6. The powered tool of claim 5, further including a linear bearing housing received in said first tube; linear bearings received in said linear bearing housing; said second tube passing through said linear bearing housing and contacting said linear bearings wherein said second tube may move freely through said linear bearing housing.

7. The powered tool of claim 6, wherein a portion of said retractable extension rod is received within said second tube; means for varying the distance in which said retractable rod extends from said second tube.

8. The powered tool of claim 7 wherein said retractable extension rod is flexible but stiff; the length of said retractable extension rod being greater than the length of said second tube; the outside diameter of said retractable extension rod being smaller than the inside diameter of said second tube.

9. The powered tool of claim 7, wherein said swivel means is a double swivel; said retractable extension rod being stiff enough to allow pressure to be applied to said work head when said work head is in contact with a work area; said double swivel permitting work to be done at an appropriate angle.

10. The powered tool of claim 9 further including means for locking and unlocking said retractable extension rod at various positions within said second tube whereby the length in which said extension rod extends from said second tube may be varied.

11. The powered tool of claim 9 wherein said means for selectively locking and unlocking said retractable extension rod includes a set screw having a knob type handle; a threaded hole being in the wall of said second tube; said set screw received in said hole in said second tube and contacting said retractable extension rod.

12. The powered tool of claim 10, further including a coupling and an attachment rod; said coupling contacting said retractable extension rod and said attachment rod; means for removing said attachment rod from said coupling.

13. The powered tool of claim 1, wherein said work head is a sanding head.

14. The powered tool of claim 1 wherein said swivel is a double swivel contacting said work head.

15. The powered tool of claim 1, wherein said elongated slots are opposed to one another by 180°; said slots being of greater width than the diameter of said push-pull rod.

16. The powered tool of claim 1 wherein said work head is a sanding head; said sanding head being of a rectangular configuration.

17. The powered tool of claim 1 wherein said drive train converts rotary motion to a reciprocating stroke.

18. The powered tool of claim 4 wherein said second tube extends from said first tube.

* * * * *